US009099781B2

(12) United States Patent
Jenwatanavet

(10) Patent No.: US 9,099,781 B2
(45) Date of Patent: Aug. 4, 2015

(54) COMPACT DUAL POLARIZATION ANTENNA

(71) Applicant: QUALCOMM Incorporated, San Diego, CA (US)

(72) Inventor: Jatupum Jenwatanavet, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 198 days.

(21) Appl. No.: 13/705,293

(22) Filed: Dec. 5, 2012

(65) Prior Publication Data

US 2014/0152529 A1 Jun. 5, 2014

(51) Int. Cl.

| | |
|---|---|
| ***H01Q 1/24*** | (2006.01) |
| ***H01Q 1/38*** | (2006.01) |
| ***H01Q 1/50*** | (2006.01) |
| ***H01Q 7/00*** | (2006.01) |
| ***H01Q 9/04*** | (2006.01) |

(52) U.S. Cl.

CPC . *H01Q 1/38* (2013.01); *H01Q 1/50* (2013.01); *H01Q 7/00* (2013.01); *H01Q 9/0421* (2013.01); *H01Q 9/0428* (2013.01)

(58) Field of Classification Search

CPC ..... H01Q 1/38; H01Q 1/50; H01Q 7/00; H01Q 9/0421; H01Q 9/0428

USPC ..... 343/700 MS, 702, 846

See application file for complete search history.

(56) References Cited

U.S. PATENT DOCUMENTS

| | | | | |
|---|---|---|---|---|
| 5,003,319 | A | 3/1991 | Murakami et al. | |
| 6,369,762 | B1 | 4/2002 | Yanagisawa et al. | |
| 7,508,345 | B2 * | 3/2009 | Pan et al. | 343/700 MS |
| 7,508,346 | B2 | 3/2009 | Rao et al. | |
| 7,511,670 | B2 | 3/2009 | Rao et al. | |
| 7,532,164 | B1 | 5/2009 | Phillips et al. | |
| 7,856,368 | B2 | 12/2010 | Avallone et al. | |
| 7,911,398 | B2 * | 3/2011 | Hsieh et al. | 343/702 |
| 8,027,661 | B2 | 9/2011 | Dawson et al. | |
| RE43,430 | E | 5/2012 | Domnitz | |
| 8,248,309 | B2 | 8/2012 | Sotoudeh | |
| 8,618,990 | B2 * | 12/2013 | Somero | 343/702 |
| 2005/0110693 | A1 | 5/2005 | Ryu et al. | |
| 2008/0284661 | A1 | 11/2008 | He | |
| 2009/0140927 | A1 | 6/2009 | Maeda et al. | |
| 2010/0245192 | A1 | 9/2010 | Kakuya et al. | |
| 2011/0221638 | A1 | 9/2011 | Lin | |
| 2011/0227793 | A1 | 9/2011 | Johnson | |
| 2011/0307338 | A1 | 12/2011 | Carlson | |

(Continued)

FOREIGN PATENT DOCUMENTS

| | | | |
|---|---|---|---|
| EP | 0431764 | A2 | 6/1991 |
| WO | WO-9956344 | A1 | 11/1999 |
| WO | WO-2004084344 | A1 | 9/2004 |

OTHER PUBLICATIONS

Fujimoto T. et al., "Analytical Method for a Circularly Polarised Rectangular Microstrip antenna", IEE Proceedings: Microwaves, Antennas and Propagation, Apr. 1, 2001, IEE, Stevenage, Herts, GB, vol. 148, No. 2, pp. 85-90, XP001058818, ISSN: 1350-2417, DOI: 10.1049/IP-MAP:20010334.

(Continued)

*Primary Examiner* — Hoanganh Le

(74) *Attorney, Agent, or Firm* — Gerald P. Joyce, III

(57) ABSTRACT

A dual polarization antenna includes a transducer element having two orthogonal sides and configured to conduct current at least two orthogonal directions.

18 Claims, 7 Drawing Sheets

(56) References Cited

U.S. PATENT DOCUMENTS

| | | | |
|---|---|---|---|
| 2012/0109751 | A1 | 5/2012 | Binenstock et al. |
| 2012/0212376 | A1 | 8/2012 | Jan et al. |

OTHER PUBLICATIONS

Hsu W-H. et al., "Circularly-polarised disk-sector microstrip antenna", Electronics Letters, Nov. 12, 1998, IEE Stevenage, GB, vol. 34, No. 23, pp. 2188-2190, XP006010620, ISSN: 0013-5194, DOI: 10.1049/EL:19981587.

International Search Report and Written Opinion—PCT/US2013/073339—ISA/EPO—Mar. 14, 2014.

Takehiko T., "On polygonal loop antennas", IEEE Transactions on Antennas and Propagation, Jul. 1, 1980, vol. AP-28, No. 4, pp. 571-575, XP002721010, USA ISSN: 0018-926X, DOI: 10.1109/tap.1980.1142380.

* cited by examiner

COMPACT DUAL POLARIZATION ANTENNA

BACKGROUND

Electronic devices, such as portable communication devices, continue to diminish in size. All such portable communication devices use some type of antenna for transmitting and receiving communication signals. In applications where minimizing device size is important and where orientation of the device during use may be arbitrary, the use of a dual polarization antenna may be beneficial. A dual polarization antenna is an antenna that can radiate and receive electromagnetic energy simultaneously in two orthogonal directions. The polarization of an antenna is generally defined as the orientation of the electric field (E-plane) of the radio wave with respect to the Earth's surface. However, incorporating such a dual polarization antenna into a small form factor communication device housing can be challenging.

Therefore, it would be desirable to have a dual polarization antenna that overcomes the above-mentioned deficiencies.

SUMMARY

In an embodiment, a dual polarization antenna includes a transducer element having two orthogonal sides and configured to conduct current at least two orthogonal directions.

BRIEF DESCRIPTION OF THE DRAWINGS

In the figures, like reference numerals refer to like parts throughout the various views unless otherwise indicated. For reference numerals with letter character designations such as "102*a*" or "102*b*", the letter character designations may differentiate two like parts or elements present in the same figure. Letter character designations for reference numerals may be omitted when it is intended that a reference numeral encompass all parts having the same reference numeral in all figures.

DETAILED DESCRIPTION

Figure 1:
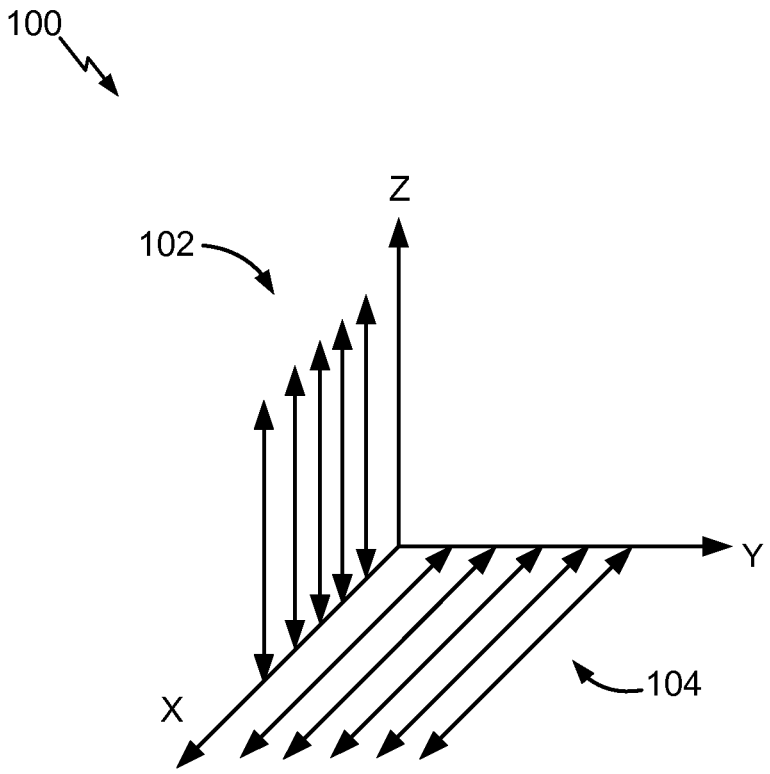
FIG. 1 is a graphical illustration showing a three-axis Cartesian coordinate system showing example orientations of electric fields of an antenna.

The word "exemplary" is used herein to mean "serving as an example, instance, or illustration." Any aspect described herein as "exemplary" is not necessarily to be construed as preferred or advantageous over other aspects.

In this description, the term "application" may also include files having executable content, such as: object code, scripts, byte code, markup language files, and patches. In addition, an "application" referred to herein, may also include files that are not executable in nature, such as documents that may need to be opened or other data files that need to be accessed.

The term "content" may also include files having executable content, such as: object code, scripts, byte code, markup language files, and patches. In addition, "content" referred to herein, may also include files that are not executable in nature, such as documents that may need to be opened or other data files that need to be accessed.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

As used herein, the term "orthogonal" refers to lines, line segments, or electric fields that are perpendicular at their point of intersection.

As used here, the term "orthogonal electric fields" refers to the orientation of two electric fields that are perpendicular to each other.

As used herein, the term "dual polarization" refers to an antenna that generates two electric fields and that has two components that are orthogonal to each other.

As used herein, the term "transducer" refers to an antenna element that can be stimulated with a feed current and radiate electromagnetic energy, and an antenna element that can receive electromagnetic energy and convert the received electromagnetic energy to a receive current that is applied to receive circuitry.

The compact dual polarization antenna can be incorporated into or used with a communication device, such as, but not limited to, a cellular telephone, a computing device, such as a smart phone, a tablet computer, or any other communication device.

FIG. 1 is a graphical illustration 100 showing a three-axis Cartesian coordinate system showing example orientations of electric fields of an antenna. The orientation of the electric field 102 generally is in the Z direction and the orientation of the electric field 104 generally is in the X direction. As used herein, the term "orthogonal" as applied to the orientation of electric field 102 and orientation of electric field 104 means that the orientation of electric field 102 is orthogonal to the orientation of electric field 104. The X direction and the Z direction are arbitrary and shown for illustration purposes only in that the electric fields can occupy any two directions that are orthogonal to each other.

The compact dual polarization antenna includes one or more transducer elements that allow the antenna to radiate and receive electromagnetic energy in two perpendicular directions while being sufficiently compact so that it can be installed inside of the housing of a communication device.

Figure 2A:
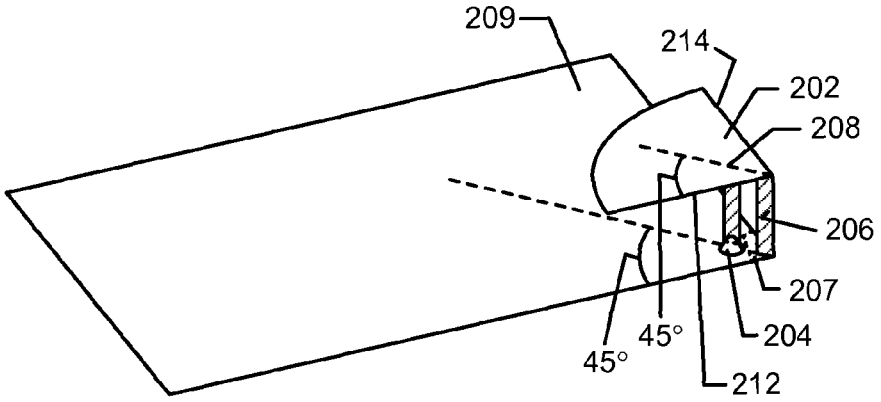
FIGS. 2A and 2B are diagrams illustrating a first embodiment of a compact dual polarization antenna.
Figure 2B:
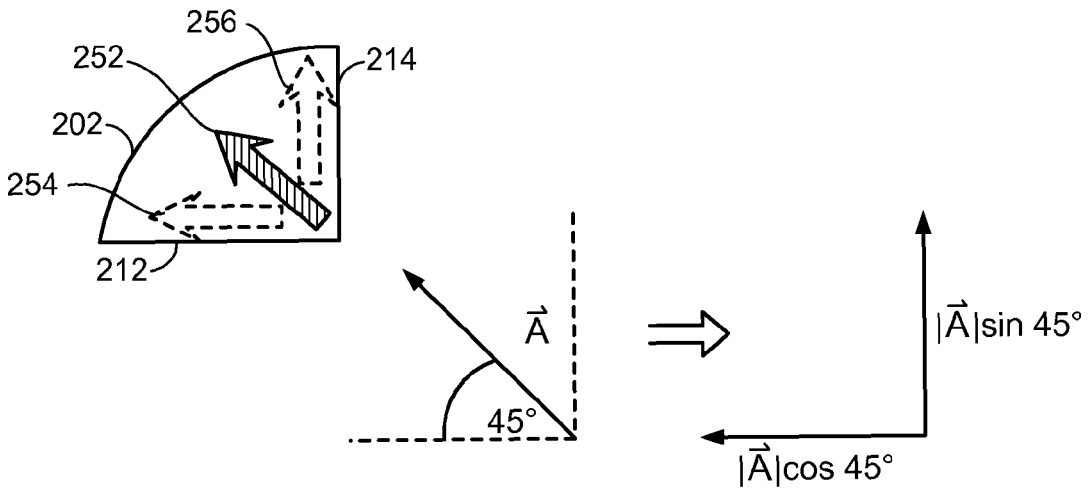

FIGS. 2A and 2B are diagrams illustrating a first embodiment of a compact dual polarization antenna. The embodiment shown in FIG. 2A and FIG. 2B is referred to as a "quarter circle" antenna because the transducer element 202 has an overall shape approximating a quarter circle. The approximate quarter circle shape may also include a segmented shape having one or more line segments that define the arcuate portion of the "circle." The antenna feed connection 204 and the antenna ground connection 206 are formed at an approximate 45 degree angle with respect to the edges 212 and 214 of the transducer element 202, generally along the line 208 and are electrically connected to the transducer element 202. The antenna ground connection 206 is electrically connected to a ground plane 207 located on a printed circuit board 209.

Referring to FIG. 2B, the vector 252 represents the current flowing in the transducer element 202. The vector 252 can be decomposed into substantially orthogonal vectors 254 and 256 by taking the absolute value of the vector 252 and multiplying it by respective sin and cosine functions. Assuming the vector 252 has a magnitude A, the orthogonal components of the vector 252 can be represented as |A| sin 45 and |A| cos 45. The vectors 254 and 256 embody the dual polarization aspect of the antenna in that they represent the two orthogonal antenna radiation directions when the transducer element 202 is used as a radiating element and refers to the two orthogonal currents generated by received electromagnetic energy when transducer element 202 is used as a receiving element. The transducer element 202 can be fabricated sufficiently small to fit within a housing of a communication device, and in an embodiment, can have a sector radius of approximately 20 millimeters (mm) In an embodiment, the antenna feed connection 204 and the antenna ground connection 206 can have a width of approximately 1.2 mm. Other dimensions are possible depending on implementation.

Figure 3A:
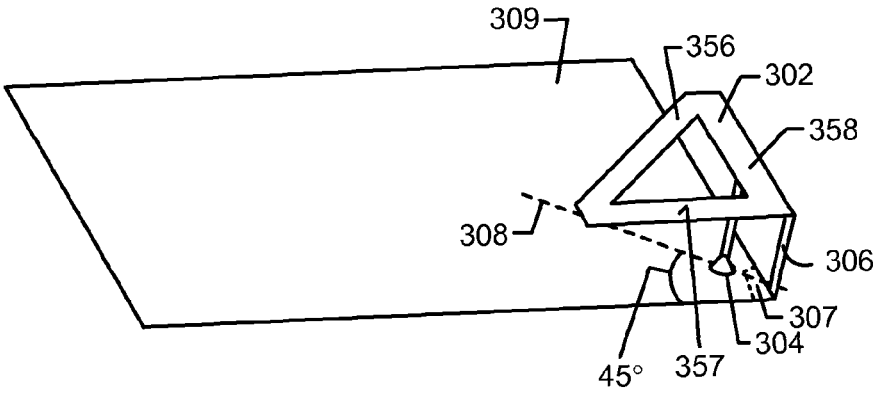
FIGS. 3A and 3B are diagrams illustrating a second embodiment of a compact dual polarization antenna.
Figure 3B:
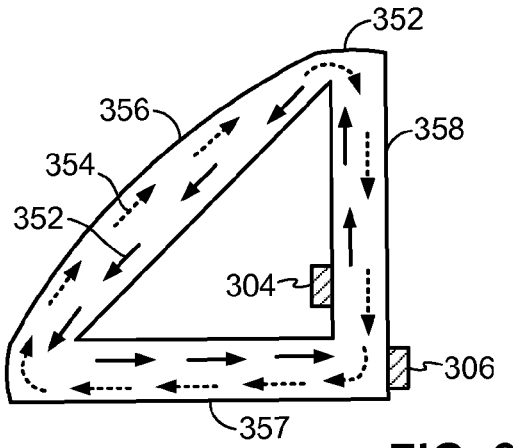

FIGS. 3A and 3B are diagrams illustrating a second embodiment of a compact dual polarization antenna. The embodiment shown in FIG. 3A and FIG. 3B is referred to as a "looped right triangle" antenna because the transducer element 302 is shaped as a continuous loop right triangle. An antenna feed connection 304 and an antenna ground connection 306 are formed at an approximate 45 degree angle with respect to the sides 357 and 358 of the transducer element 302, generally along the line 308 and are electrically connected to the transducer element 302. The antenna ground connection 306 is electrically connected to a ground plane 307 located on a printed circuit board 309.

Referring to FIG. 3B, the arrows 352 and 354 represent bi-directional current flow in the transducer element 302. The circulation of bi-directional current flow embodies the dual polarization aspect of the antenna in that they represent the two orthogonal antenna radiation directions when the transducer element 302 is used as a radiating element and refers to the two orthogonal currents generated by received electromagnetic energy when transducer element 302 is used as a receiving element. The transducer element 302 can be fabricated sufficiently small to fit within a housing of a communication device. In an embodiment, the transducer element 302 can have a long side 356 having a length of approximately 30 mm and a width of approximately 4 mm. The transducer element 302 can have short sides 357 and 358 each having a length of approximately 21 mm and a width of approximately 4 mm. In an embodiment, the antenna feed connection 304 and the antenna ground connection 306 can have a width of approximately 1.2 mm. Other dimensions are possible depending on implementation.

Figure 4A:
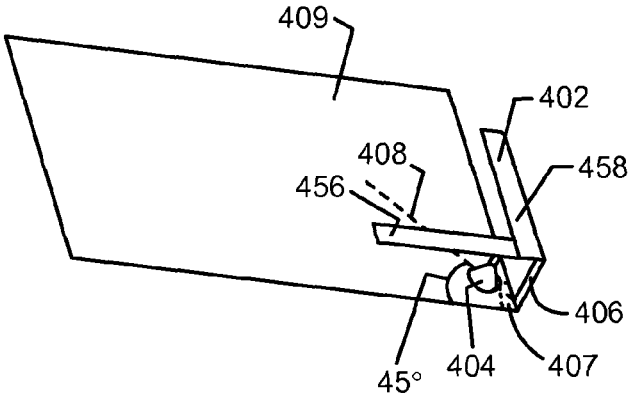
FIGS. 4A and 4B are diagrams illustrating a third embodiment of a compact dual polarization antenna.
Figure 4B:
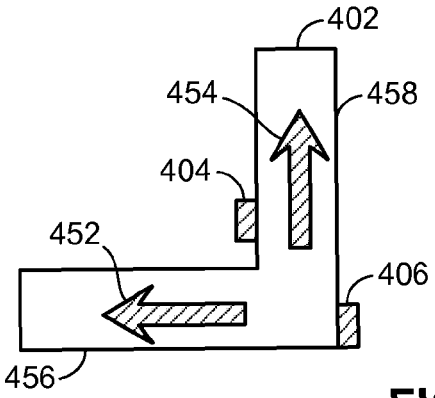
Figure 5A:
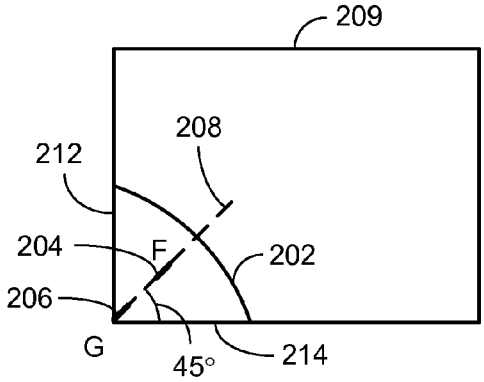
FIGS. 5A through 5E are graphical illustrations showing embodiments of the transducer element of FIGS. 2A and 2B.
Figure 5B:
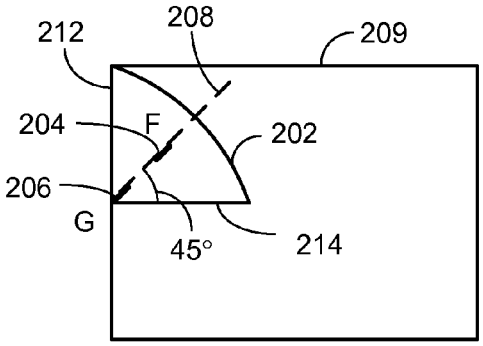
Figure 5C:
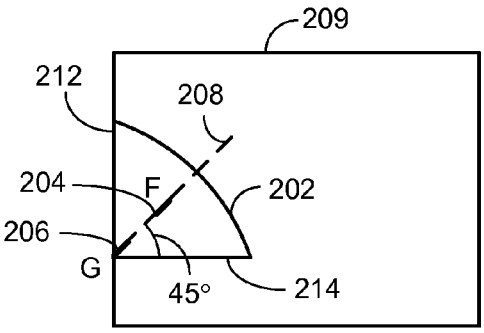
Figure 5D:
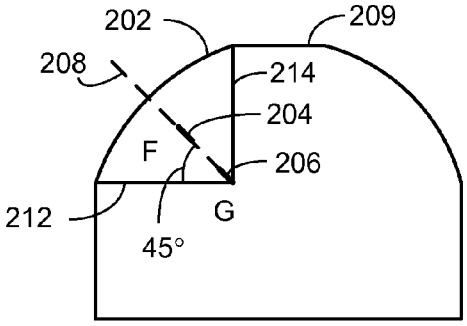
Figure 5E:
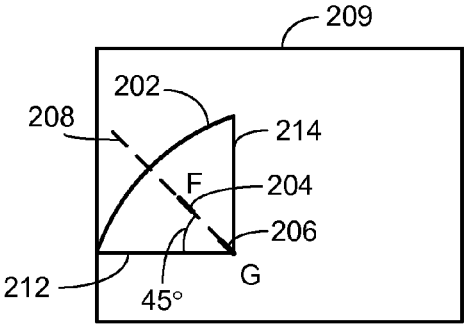

FIGS. 4A and 4B are diagrams illustrating a third embodiment of a compact dual polarization antenna. The embodiment shown in FIG. 4A and FIG. 4B is referred to as an "L shape" antenna because the transducer element 402 is generally L shaped. An antenna feed connection 404 and an antenna ground connection 406 are formed at an approximate 45 degree angle with respect to the legs 456 and 458 of the transducer element 402 generally along the line 408 and are electrically connected to the transducer element 402. The antenna ground connection 406 is electrically connected to a ground plane 407 located on a printed circuit board 409.

Referring to FIG. 4B, the arrows 452 and 454 represent current flowing in two orthogonal directions in the transducer element 402. The current flow embodies the dual polarization aspect of the antenna in that they represent the two orthogonal antenna radiation directions when the transducer element 402 is used as a radiating element and refers to the two orthogonal currents generated by received electromagnetic energy when transducer element 402 is used as a receiving element. The transducer element 402 can be fabricated sufficiently small to fit within a housing of a communication device. In an embodiment, the transducer element 402 can have a first leg 456 having a length of approximately 24 mm and a width of approximately 4 mm, and a second leg 458 having a length of approximately 24 mm and a width of approximately 4 mm. In an embodiment, the antenna feed connection 404 and the antenna ground connection 406 can have a width of approximately 1.2 mm. Other dimensions are possible depending on implementation.

In the embodiments described herein, when the transducer element is used as a radiating element, a feed current is provided from the antenna feed connection to the transducer element and an electromagnetic radiation pattern comprising orthogonal currents is radiated from the transducer element. When the transducer element is used as a receive element, the transducer element receives electromagnetic energy and converts the received electromagnetic energy to orthogonal currents that are provided to the antenna feed connection, and to receive circuitry associated with a communication device in which the compact dual polarization antenna is incorporated.

FIGS. 5A through 5E are graphical illustrations showing embodiments of the transducer element 202 of FIGS. 2A and 2B. Although shown in FIGS. 5A through 5E as being located in specific locations, the transducer element 202 can be located anywhere over the ground plane 209. In certain implementations, it may be preferable to have the transducer element 202 located with one of the straight sides located parallel with a straight side of the ground plane 209. However, in other implementations, the transducer element 202 can be located anywhere over the ground plane 209.

The antenna feed connection 204 and the antenna ground connection 206 are shown in each view for reference. The antenna feed connection 204 and the antenna ground connection 206 are formed at an approximate 45 degree angle with respect to the edges 212 and 214 of the transducer element 202, generally along the line 208. A printed circuit board 209 is shown for reference.

Figure 6A:
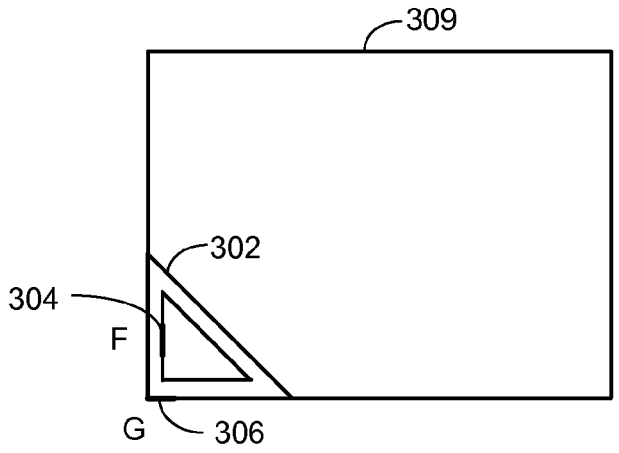
FIGS. 6A through 6C are graphical illustrations showing embodiments of the transducer element of FIGS. 3A and 3B.
Figure 6B:
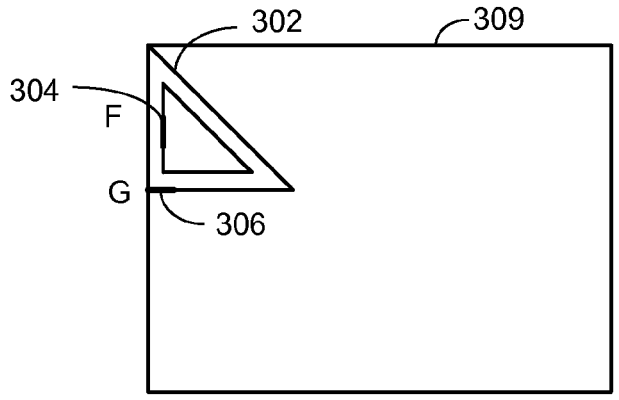
Figure 6C:
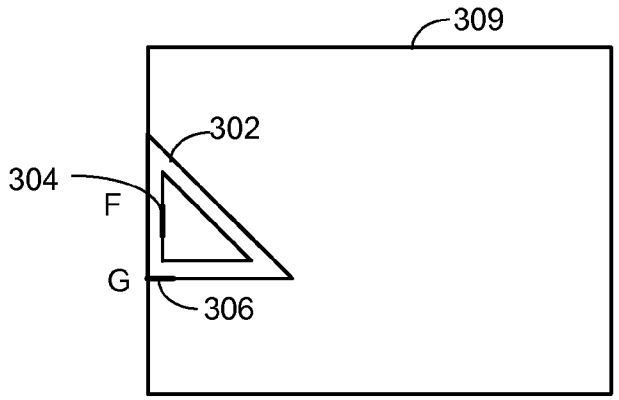

FIGS. 6A through 6C are graphical illustrations showing embodiments of the transducer element 302 of FIGS. 3A and 3B. Although shown in FIGS. 6A through 6C as being located in specific locations, the transducer element 302 can be located anywhere over the ground plane 309.

The antenna feed connection 304 and the antenna ground connection 306 are shown in each view for reference. A printed circuit board 309 is shown for reference.

Figure 7A:
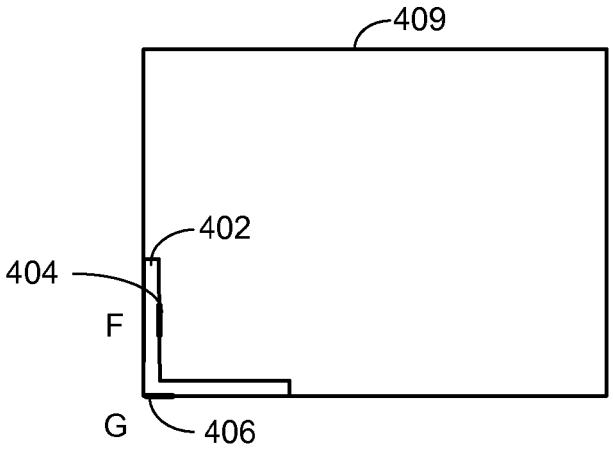
FIGS. 7A through 7C are graphical illustrations showing embodiments of the transducer element of FIGS. 4A and 4B.
Figure 7B:
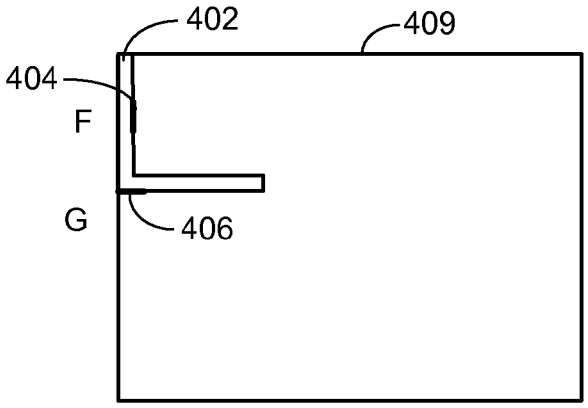
Figure 7C:
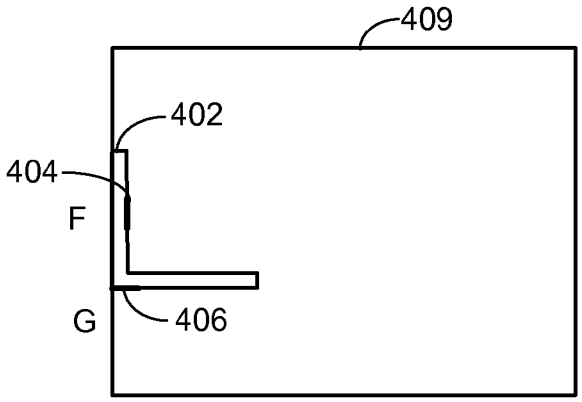

FIGS. 7A through 7C are graphical illustrations showing embodiments of the transducer element 402 of FIGS. 4A and 4B. Although shown in FIGS. 7A through 7C as being located in specific locations, the transducer element 402 can be located anywhere over the ground plane 409.

The antenna feed connection 404 and the antenna ground connection 406 are shown in each view for reference. A printed circuit board 409 is shown for reference.

Figure 8:
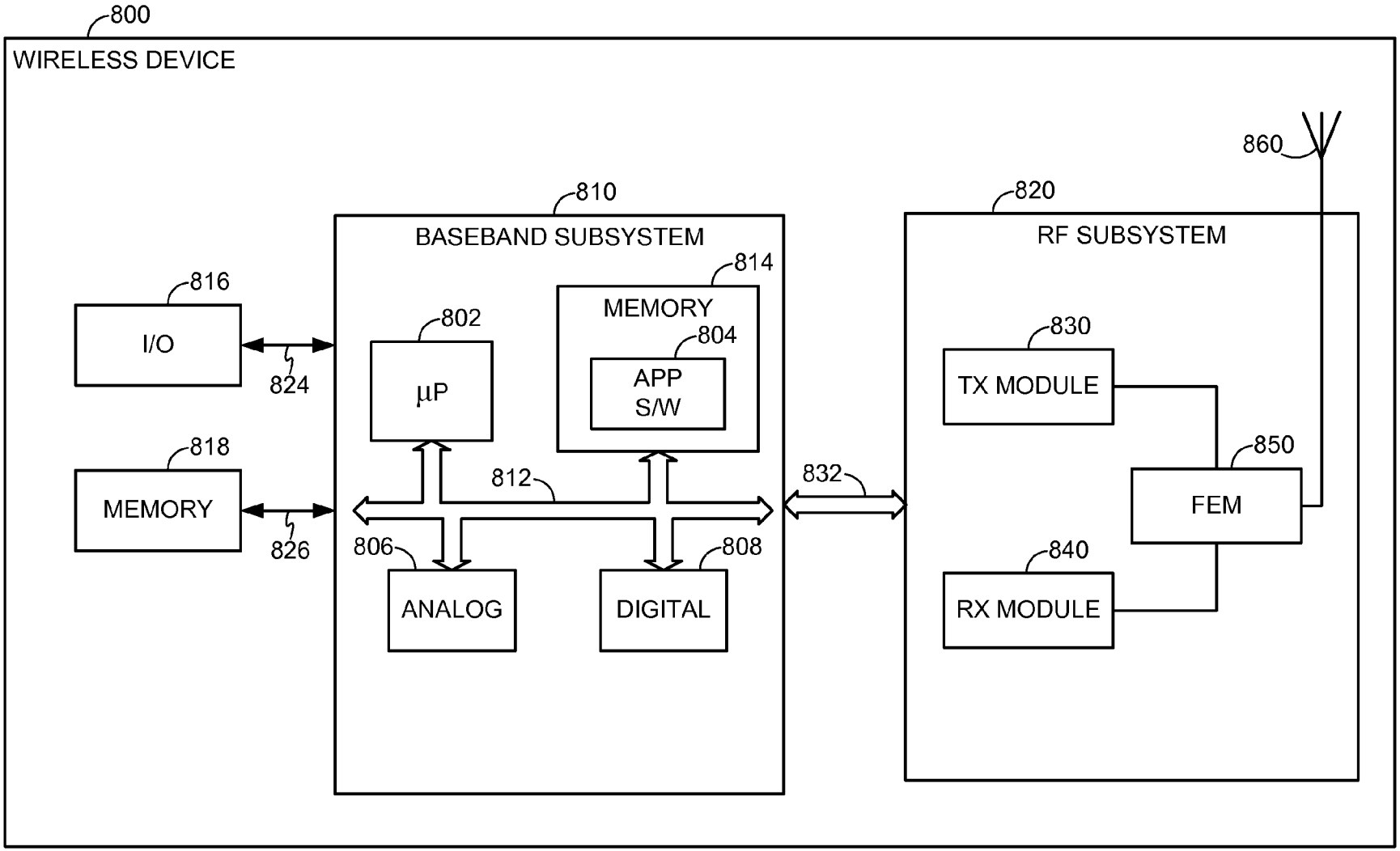
FIG. 8 is a block diagram illustrating an example of a wireless device in which the compact dual polarization antenna can be implemented.

FIG. 8 is a block diagram illustrating an example of a wireless device 800 in which the compact dual polarization antenna can be implemented. In an embodiment, the wireless device 800 can be a "Bluetooth" wireless communication device, a portable cellular telephone, a WiFi enabled communication device, or can be any other communication device. Embodiments of the compact dual polarization antenna can be implemented in any communication device. The wireless device 800 illustrated in FIG. 8 is intended to be a simplified example of a cellular telephone and to illustrate one of many possible applications in which the compact dual polarization antenna can be implemented. One having ordinary skill in the art will understand the operation of a portable cellular telephone, and, as such, implementation details are omitted. In an embodiment, the wireless device 800 includes a baseband subsystem 810 and an RF subsystem 820 connected together over a system bus 832. The system bus 832 can comprise physical and logical connections that couple the above-described elements together and enable their interoperability. In an embodiment, the RF subsystem 820 can be a wireless transceiver. Although details are not shown for clarity, the RF subsystem 820 generally includes a transmit module 830 having modulation, upconversion and amplification circuitry for preparing a baseband information signal for transmission, includes a receive module 840 having amplification, filtering and downconversion circuitry for receiving and downconverting an RF signal to a baseband information signal to recover data, and includes a front end module (FEM) 850 that includes diplexer circuitry, duplexer circuitry, or any other circuitry that can separate a transmit signal from a receive signal, as known to those skilled in the art. An antenna 860 is connected to the FEM 850. The antenna 860 can comprise any of the embodiments of a compact dual polarization antenna as described herein. When implemented as shown in FIG. 8, the compact dual polarization antenna can be implemented as part of one or modules that comprise the RF subsystem 820.

The baseband subsystem 810 generally includes a processor 802, which can be a general purpose or special purpose microprocessor, memory 814, application software 804, analog circuit elements 806, and digital circuit elements 808, coupled over a system bus 812. The system bus 812 can comprise the physical and logical connections to couple the above-described elements together and enable their interoperability.

An input/output (I/O) element 816 is connected to the baseband subsystem 810 over connection 824 and a memory element 818 is coupled to the baseband subsystem 810 over connection 826. The I/O element 816 can include, for example, a microphone, a keypad, a speaker, a pointing device, user interface control elements, and any other devices or system that allow a user to provide input commands and receive outputs from the portable communication device 800.

The memory 818 can be any type of volatile or non-volatile memory, and in an embodiment, can include flash memory. The memory 818 can be permanently installed in the portable communication device 800, or can be a removable memory element, such as a removable memory card.

The processor 802 can be any processor that executes the application software 804 to control the operation and functionality of the portable communication device 800. The memory 814 can be volatile or non-volatile memory, and in an embodiment, can be non-volatile memory that stores the application software 804.

The analog circuitry 806 and the digital circuitry 808 include the signal processing, signal conversion, and logic that convert an input signal provided by the I/O element 816 to an information signal that is to be transmitted. Similarly, the analog circuitry 806 and the digital circuitry 808 include the signal processing elements used to generate an information signal that contains recovered information from a received signal. The digital circuitry 808 can include, for example, a digital signal processor (DSP), a field programmable gate array (FPGA), or any other processing device. Because the baseband subsystem 810 includes both analog and digital elements, it can be referred to as a mixed signal device (MSD).

In view of the disclosure above, one of ordinary skill in programming is able to write computer code or identify appropriate hardware and/or circuits to implement the disclosed invention without difficulty based on the flow charts and associated description in this specification, for example. Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and Blu-Ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention, as defined by the following claims.

What is claimed is:

1. A communication device having a dual polarization antenna, comprising:

a transducer element having two orthogonal sides joining at an end to form a first plane and configured to conduct current in at least two orthogonal directions; and a feed connection and a ground connection electrically connected to the transducer element, the feed connection and the ground connection being formed along a line in a second plane intersecting the first plane perpendicularly, and the line going through the end and being oriented at approximately 45 degrees to each of the two orthogonal sides.

2. The communication device of claim 1, wherein the transducer element comprises a quarter circle shape.

3. The communication device of claim 1, wherein the transducer element comprises a loop right triangle shape.

4. The communication device of claim 1, wherein the transducer element comprises an L shape.

5. The communication device of claim 1, wherein the transducer element is configured to receive a feed current and decompose the feed current into two orthogonal currents according to sin and cosine functions of the feed current.

6. The communication device of claim 1, wherein the feed connection provides a feed current to the transducer element and the transducer element comprises a radiating antenna configured to radiate electromagnetic energy.

7. The communication device of claim 1, wherein the transducer element comprises a receive antenna configured to receive electromagnetic energy and generate a current at the feed connection.

8. A dual polarization antenna, comprising:

a transducer element having two orthogonal sides joining at an end to form a first plane and configured to conduct current at least two orthogonal directions; and a feed connection and a ground connection electrically connected to the transducer element, the feed connection and the ground connection being formed along a line in a second plane intersecting the first plane perpendicularly, and the line going through the end and being oriented at approximately 45 degrees to each of the two orthogonal sides.

9. The dual polarization antenna of claim 8, wherein the transducer element comprises a quarter circle shape.

10. The dual polarization antenna of claim 8, wherein the transducer element comprises a loop right triangle shape.

11. The dual polarization antenna of claim 8, wherein the transducer element comprises an L shape.

12. The dual polarization antenna of claim 8, wherein the transducer element is configured to receive a feed current and decompose the feed current into two orthogonal currents according to sin and cosine functions of the feed current.

13. The dual polarization antenna of claim 8, wherein the feed connection provides a feed current to the transducer element and the transducer element comprises a radiating antenna configured to radiate electromagnetic energy.

14. The dual polarization antenna of claim 8, wherein the transducer element comprises a receive antenna configured to receive electromagnetic energy and generate a current at the feed connection.

15. A dual polarization antenna, comprising:

a ground plane;

a transducer element located over the ground plane, the transducer element having two orthogonal sides joining at an end to form a first plane and configured to conduct current at least two orthogonal directions;

a feed connection electrically connected to the transducer element; and a ground connection electrically connected to the transducer element, the feed connection and the ground connection being formed along a line in a second plane intersecting the first plane perpendicularly, and the line going through the end and being oriented at approximately 45 degrees to each of the two orthogonal sides.

16. The dual polarization antenna of claim 15, wherein the transducer element comprises a shape chosen from a quarter circle shape, a loop right triangle shape and an L shape.

17. The dual polarization antenna of claim 15, wherein a feed current is received and decomposed into two orthogonal currents according to sin and cosine functions of the feed current.

18. The dual polarization antenna of claim 15, wherein the transducer element comprises a receive antenna configured to receive electromagnetic energy and generate a current at the feed connection.

* * * * *